United States Patent [19]

Turner et al.

[11] 4,037,624

[45] July 26, 1977

[54] SPOUT ASSEMBLY

[75] Inventors: Larry G. Turner, Waterford; Dennis W. Crawford, Pontiac, both of Mich.

[73] Assignee: Bristol Products, Inc., Bristol, Ind.

[21] Appl. No.: 662,710

[22] Filed: Mar. 1, 1976

[51] Int. Cl.[2] ..... E03C 1/04

[52] U.S. Cl. ..... 137/615; 137/801; 285/190

[58] Field of Search ..... 137/615, 801; 285/190

[56] References Cited

U.S. PATENT DOCUMENTS 2,570,635 10/1951 Beyer ..... 137/801 X

*Primary Examiner*—Alan Cohan
*Assistant Examiner*—Gerald A. Michalsky
*Attorney, Agent, or Firm*—Oltsch & Knoblock

[57] ABSTRACT

A spout assembly which includes a spout member fitted pivotally within a base. A fluid inlet is formed in the base whereby fluid may pass through the base and out the spout. The spout is preferably supported at both its internal and external diameters by the base so as to provide a more rigid assembly as well as to lengthen the life of the fluid seal between the base and spout.

15 Claims, 5 Drawing Figures

Fig. 3
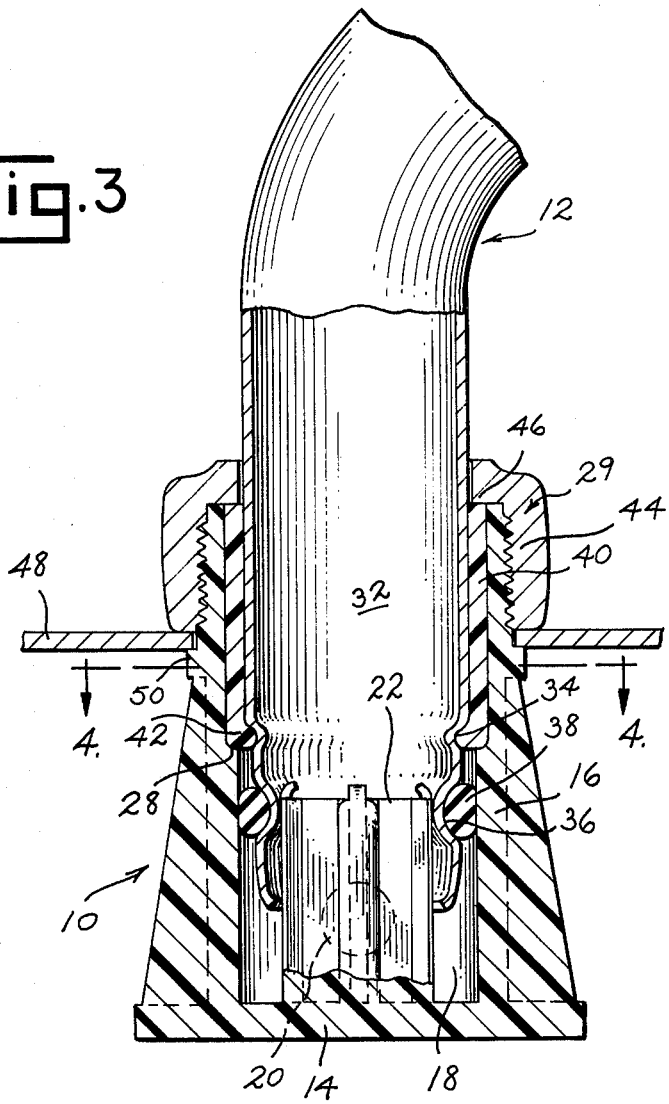
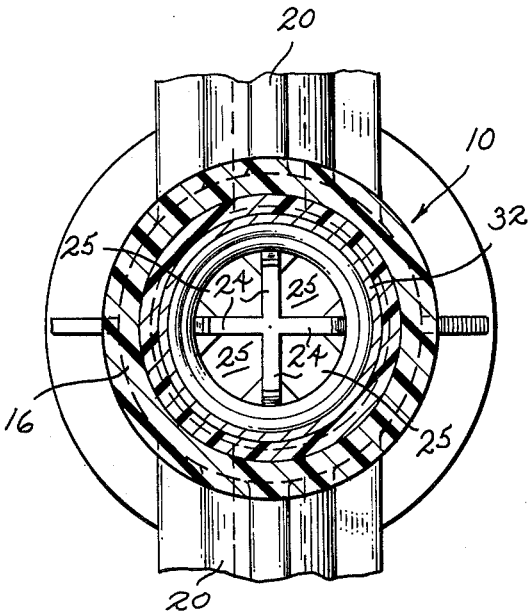
Fig. 4

SPOUT ASSEMBLY

SUMMARY OF THE INVENTION

This invention relates to a spout assembly and will have specific but not limited application to spout assemblies utilized with wash basins, sinks and similar laundry, wash room, kitchen and bathroom fixtures.

The spout assembly includes a base having a cavity formed in it defined by bottom and side walls. The inlet end portion of a spout is fitted within the base cavity and is preferably supported by the base both internally at its inner diameter and externally at its outer diameter. In this manner the spout is rotatable relative to the base about a generally fixed axis of rotation which decreases the wear upon the fluid seal between the base and spout and which serves to make the assembly more durable.

Accordingly, it is an object of this invention to provide a spout assembly in which the spout thereof is rotatable about a substantially fixed axis of rotation.

Still another object of this invention is to provide a spout assembly which is of a rigid and durable construction.

Still another object of this invention is to provide a spout assembly having minimal seal ring wear between the rotatable spout and fixed base of the assembly.

Other objects of this invention will become apparent upon a reading of the invention's description.

BRIEF DESCRIPTION OF THE DRAWINGS

A preferred embodiment of this invention has been chosen for purposes of illustration and description wherein:

FIG. 3 is a vertical sectional view of the spout assembly in its assembled form.

FIG. 4 is a cross sectional view taken along line 4—4 of FIG. 3.

DESCRIPTION OF THE PREFERRED EMBODIMENT

Figure 1:
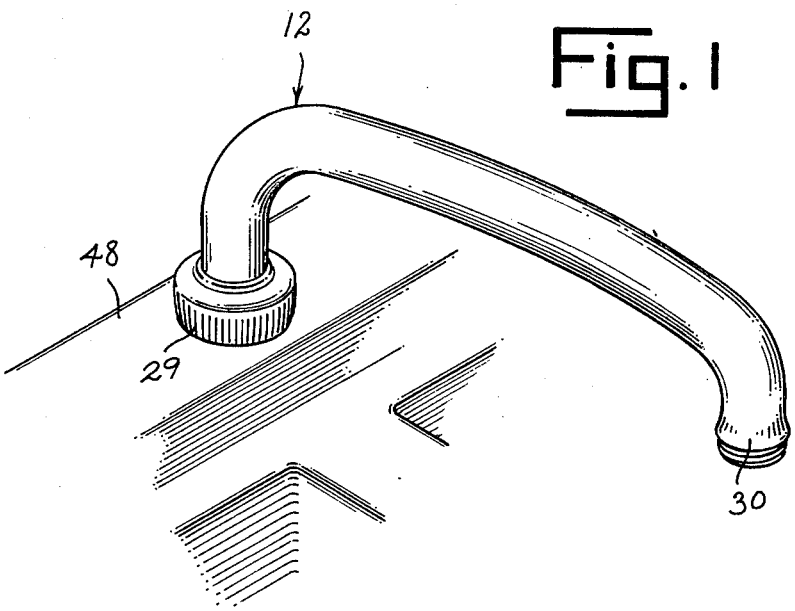
FIG. 1 is a perspective view of the spout assembly shown mounted to a sink.
Figure 2:
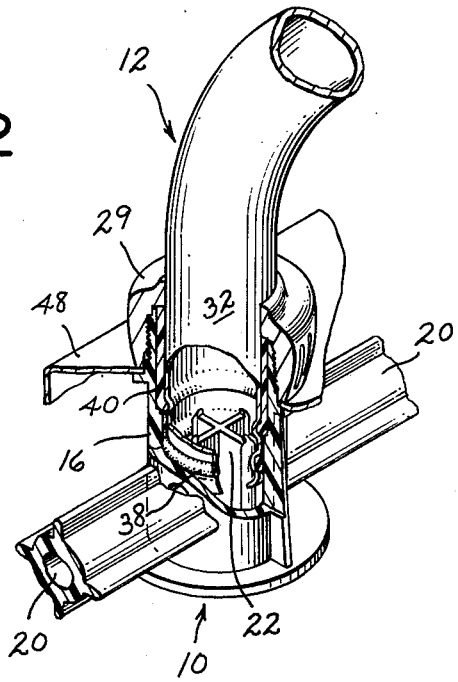
FIG. 2 is a fragmentary perspective view of the spout assembly showing a portion of the component parts thereof broken away and sectioned for purposes of illustration.
Figure 5:
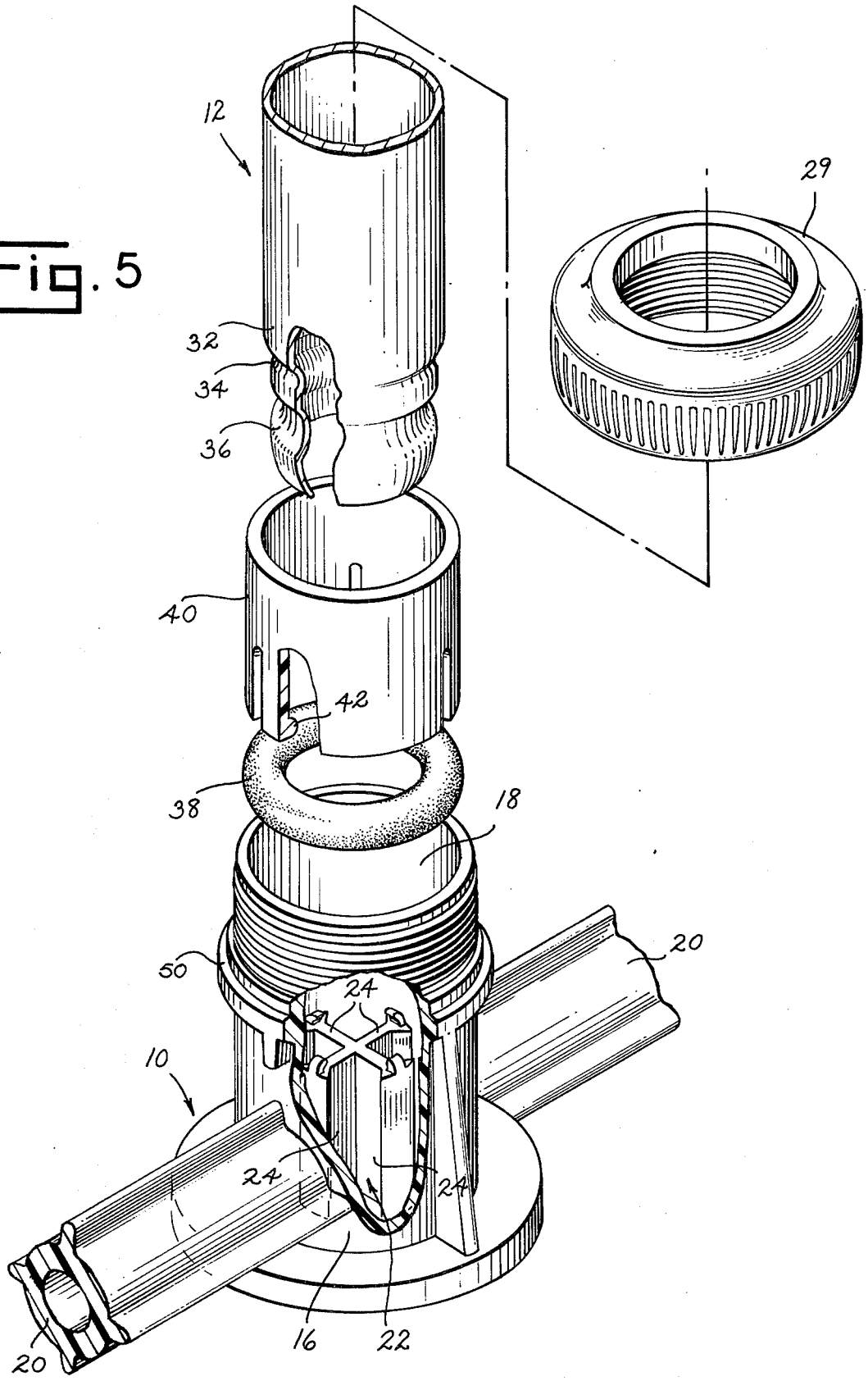
FIG. 5 is a perspective view showing the component parts of the spout assembly in exploded form with portions of the component parts broken away for purposes of illustration.

The preferred embodiment illustrated is not intended to be exhaustive or to limit the invention to the precise form disclosed. It has been chosen and described in order to best explain the principles of the invention and its application and practical use to thereby enable others skilled in the art to best utilize the invention.

The spout assembly includes a base 10 and a rotative spout 12. Base 10 includes a bottom wall 14 and an annular side wall 16 which cooperate to define a cylindrical cavity 18. Base 10 includes a pair of conduits 20 which define inlet ports into the bottom of cavity 18. Conduits 20 are utilized to conduct a fluid, such as water, into cavity 18 of the base. The spout assembly illustrated has application to sinks and wash basins with one conduit 20 being connected into the hot water system and the other conduit being connected into the cold water system of the water supply for the sink or basin.

In other applications of the spout assembly of this invention the base may have only one fluid inlet port.

A projection 22 extends upwardly from bottom wall 14 of the base within cavity 18. Projection 22 is spaced from side wall 16 of the base and includes a plurality of equal angularly spaced ribs 24 which project radially outwardly from a common axis generally coinciding with the axis of base cavity 18. The upper end of cavity 18 is slightly enlarged so as to form an internal annular shoulder 28 in base side wall 16. The upper end of base side wall 16 is externally threaded for the purpose of receiving a collar 29 whose function will be later described.

Spout 12 includes an outer end portion 30 and an inner end portion 32. Outer end portion 30 of the spout is where the fluid such as water exits from the spout assembly. Inner end portion 32 of the spout is provided with two circumferential grooves 34 and 36. Groove 36 is located adjacent the lower or inner end of the spout and carries an O-ring 38. A sleeve 40 fits snugly about spout inner end portion 32 and includes an inturned annular lip 42 which is fitted into groove 34 in the spout to secure the sleeve against lengthwise movement along the spout. Collar 29 includes a threaded flange 44 and an inturned annular lip 46.

In assemblying spout 12 and base 10, collar 29 is slipped over the inner end of the spout. Then sleeve 40 is fitted over the inner end of the spout with its lip 42 snap fitting into groove 34. O-ring 38 would then be slipped over the inner end of the spout and fitted into groove 36. The assembled spout is then fitted into the upper open end of base cavity 18 with sleeve 40 fitting snugly within the enlarged portion of cavity 18 and seating upon base shoulder 28. Projection 22 of base 10 extends into the inner end of the spout and peripherally contacts the internal diameter of spout inner end portion 32 at groove 36. O-ring 38 is compressed between spout inner end portion 32 and side wall 16 of base 10 with the O-ring being positioned above the inlet ports of conduits 20.

With inner end portion 32 of spout 12 fitted into cavity 18, collar 29 is turned onto the threaded end of base side wall 16 with its lip 46 overlying the upper end edge of sleeve 40. In this manner spout 10 is prevented from being pushed further into cavity 18 by the engagement of sleeve 40 with shoulder 26 and from being withdrawn from base cavity 18 by the abutment of sleeve 40 with lip 46 of collar 29. Spout 12 may be rotated relative to base 10 so as to selectively position its outer end portion 30. During rotation of the spout within base 10, projection 22 and sleeve 40 serve as bearing members. Depending upon the fit of sleeve 40 about the spout 12 and within base 10, the spout may rotate relative to the sleeve or the sleeve may be carried by the spout and rotate relative to the base.

By supporting inner end portion 32 of spout 12 at both its outer and internal diameters for rotation relative to base 10, wobble of the spout relative to base 10 is substantially prevented and the life of O-ring 38 is extended. The spaces or interstices 25 between ribs 24 of projection 22 provide flow paths for the fluid from conduits 20 into spout 12.

In FIG. 1 the spout assembly of this invention is shown mounted to a sink and having a cover plate 48 positioned over base 10. Cover plate 48 is clamped between an external shoulder 50 formed on side wall 16 of base 10 and the lower edge of flange 44 of collar 28. Sleeve 40 and projection 22 of base 10 are preferably formed of a nylon or similar low-friction material to facilitate rotation of the spout within the base. In the preferred embodiment the entire base, including its projection 22 is formed of molded plastic material.

It is to be understood that the invention is not to be limited to the details above given but may be modified within the scope of the appended claims.

What I claim is:

1. A spout assembly comprising a base having a bottom wall and a side wall, said bottom and side walls defining a cavity within said base having an open end, a fluid inlet port formed in said base and extending into said cavity, projection means carried by said base bottom wall and spaced from said base side wall, a spout having a bore therethrough with inlet and outlet end portions, said spout inlet portion fitting into said base cavity through the open end thereof and over said projection means, means securing said spout inlet portion within said base cavity for rotative movement of the spout relative to the base to position said spout outlet portion at selected angular locations, said projection means extending into said spout bore and contacting said spout inlet portion within said bore for guidably anchoring said inlet portion during said rotative movement of the spout, said projection means defining a fluid passage from said inlet port into said spout bore, said projection means including spaced ribs contacting said spout inlet portion within said spout bore, said ribs having an interstice therebetween defining said fluid passage.

2. A spout assembly comprising a base having a bottom wall and a side wall, said bottom and side walls defining a cavity within said base having an open end, a fluid inlet port formed in said base and extending into said cavity, projection means carried by said base bottom wall and spaced from said base side wall, a spout having a bore therethrough with inlet and outlet end portions, said spout inlet portion fitting into said base cavity through the open end thereof and over said projection means, means securing said spout inlet portion within said base cavity for rotative movement of the spout relative to the base to position said spout outlet portion at selected angular locations, said projection means extending into said spout bore and contacting said spout inlet portion within said bore for guidably anchoring said inlet portion during said rotative movement of the spout, said projection means defining a fluid passage from said inlet port into said spout bore, said spout inlet portion having a circumferential external groove, said base side wall having an internal shoulder formed within said cavity and spaced from said base end wall, said spout securing means including a sleeve and collar means, said sleeve fitted about said spout inlet portion and including lip means seated within said spout groove for securing said sleeve against longitudinal movement along said spout, said sleeve fitting within said cavity at its open end and seated upon said base shoulder, said collar means fitted about said spout and overlying said sleeve at said cavity opening for securing said sleeve within said cavity, and means for securing said collar means to said base.

3. The spout assembly of claim 2 wherein said sleeve constitutes bearing means for providing rotation between said spout and base side wall.

4. The spout assembly of claim 3 and a fluid seal between said spout inlet portion and base side wall above said fluid inlet port.

5. The spout assembly of claim 4 wherein said seal is an O-ring fitted about said spout inlet portion and compressed against said base side wall within said cavity.

6. The spout assembly of claim 5 wherein said spout inlet portion includes a second circumferential external groove located between said first groove and the end of the inlet portion, said O-ring fitted within said second groove.

7. The spout assembly of claim 2 wherein said sleeve lip part is formed at one end of the sleeve, the opposite end of the sleeve extending to said cavity open end, said collar means fitted with clearance about said spout and including an inturned lip overlying said sleeve opposite end.

8. The spout assembly of claim 7 wherein said means for securing said collar means to said base constitutes mutually engaging threads carried by said collar means and base.

9. A spout assembly comprising a base having a bottom wall and a side wall, said bottom and side walls defining a cavity within said base having an open end, a fluid inlet port formed in said base and extending into said cavity, a spout having a bore therethrough with inlet and outlet end portions, said spout inlet portion fitting into said base cavity through the open end thereof, means securing said spout inlet portion within said base cavity for rotative movement of the spout relative to the base to position said spout outlet portion at selected angular locations, said spout inlet portion having a circumferential external groove, said base side wall having an internal shoulder formed within said cavity and spaced from said base end wall, said spout securing means including a sleeve and collar means, said sleeve fitted about said spout inlet portion and including lip means seated within said spout groove for securing said sleeve against longitudinal movement along said spout, said sleeve fitting within said cavity at its open end and seated upon said base shoulder, said collar means fitted about said spout and overlying said sleeve at said cavity opening for securing said sleeve within said cavity, and means for securing said collar means to said base.

10. The spout assembly of claim 9 wherein said sleeve constitutes bearing means for providing rotation between said spout and base side wall.

11. The spout assembly of claim 10 and a fluid seal between said spout inlet portion and base side wall above said fluid inlet port.

12. The spout assembly of claim 11 wherein said seal is an O-ring fitted about said spout inlet portion and compressed against said base side wall within said cavity.

13. The spout assembly of claim 12 wherein said spout inlet portion includes a second circumferential external groove located between said first groove and the end of the inlet portion, said O-ring fitted within said second groove.

14. The spout assembly of claim 11 wherein said sleeve lip part is formed at one end of the sleeve, the opposite end of the sleeve extending to said cavity open end, said collar means fitted with clearance about said spout and including an inturned lip overlying said sleeve opposite end.

15. The spout assembly of claim 14 wherein said means for securing said collar means to said base constitutes mutually engaging threads carried by said collar means and base.

* * * * *